US011688218B2

(12) United States Patent
Khalid

(10) Patent No.: US 11,688,218 B2
(45) Date of Patent: Jun. 27, 2023

(54) INTELLIGENT SECURE KEYPAD KEYLESS TRANSMITTER

(71) Applicant: Abdulla Khalid, Laguna Niguel, CA (US)

(72) Inventor: Abdulla Khalid, Laguna Niguel, CA (US)

( * ) Notice: Subject to any disclaimer, the term of this patent is extended or adjusted under 35 U.S.C. 154(b) by 0 days.

(21) Appl. No.: 17/464,001

(22) Filed: Sep. 1, 2021

(65) Prior Publication Data

US 2021/0407237 A1 Dec. 30, 2021

Related U.S. Application Data

(63) Continuation-in-part of application No. 16/787,800, filed on Feb. 11, 2020, now abandoned, which is a continuation-in-part of application No. 16/733,561, filed on Jan. 3, 2020, now abandoned.

(60) Provisional application No. 62/788,735, filed on Jan. 4, 2019.

(51) Int. Cl.
*G07C 9/00* (2020.01)

(52) U.S. Cl.
CPC ..... *G07C 9/00896* (2013.01); *G07C 9/00658* (2013.01); *G07C 2009/00769* (2013.01); *G07C 2009/00928* (2013.01)

(58) Field of Classification Search
CPC ..... G07C 9/00896; G07C 9/00658; G07C 2009/00769; G07C 2009/00928
USPC ..... 235/472.03
See application file for complete search history.

(56) References Cited

U.S. PATENT DOCUMENTS

| | | | |
|---|---|---|---|
| 10,389,982 | B1 | 8/2019 | Fu et al. |
| 2018/0075681 | A1 | 3/2018 | Scalisi et al. |
| 2019/0333302 | A1 | 10/2019 | Kagnew et al. |
| 2020/0253026 | A1 | 8/2020 | Allan |

*Primary Examiner* — Daniel A Hess

(74) *Attorney, Agent, or Firm* — The Law Office of Patrick F. O'Reilly III, LLC

(57) ABSTRACT

The present invention is directed to intelligent secure keyless keypad transmitter entry system mounted outside property integrated into an existing motorized garage door opening system or any motorized gate system for secure entry and package delivery using a barcode scanner. The invention uses package tracking codes stored in advance to open a door or gate with a delivery notification to the owner. Motion detection and facial recognition biometric cameras allow invited persons to enter property. The camera and microphone/speaker allow video communication via external devices. The keypad may be used in conjunction with the LED screen to program the console device with temporary or permanent PIN codes for entry code allowing owners to verify access and exit of service providers. The console device offers complete remote control of device functions and all activity on the device to be transmitted electronically to the owner's mobile device.

26 Claims, 14 Drawing Sheets

INTELLIGENT SECURE KEYPAD KEYLESS TRANSMITTER

CROSS REFERENCE

This application is a continuation-in-part and claims benefit of U.S. patent application Ser. No. 16/787,800 filed Feb. 11, 2020, which is a continuation-in-part and claims benefit of U.S. patent application Ser. No. 16/733,561 filed Jan. 3, 2020, which is a non-provisional and claims benefit of U.S. Provisional Application No. 62/788,735 filed Jan. 4, 2019, the specifications of which are incorporated herein in their entirety by reference.

BACKGROUND OF THE INVENTION

The present invention relates to secure keyless opening methods for garage doors or other entry systems to be used for home delivery through a barcode sensor, or alternative entry to the premises through a PIN code, facial recognition, or a terminal such as an external software application.

BRIEF SUMMARY OF THE INVENTION

It is an objective of the present invention to provide an improved wall-mountable console device with intelligent, secure, and keyless entry methods for garage doors, gates, and like barriers, as specified in the independent claims. Embodiments of the invention are given in the dependent claims. Embodiments of the present invention can be freely combined with each other if they are not mutually exclusive.

The present invention provides an improved wall-mountable console device with intelligent, secure, and keyless entry methods for garage doors, gates, and like barriers. The invention provides a wall-mountable console device that replaces cumbersome conventional numeric keypad programming with an easy-to-follow menu-driven programming methodology and/or a connected external software application. The invention further provides a menu-driven programming methodology where individual visual indicators signal a menu choice. The present invention conveys the nature of secure entry and provides a user with meaningful programming and instant feedback on the LED screen of the console device or on a connected external software application.

The present invention further provides the ability to easily program the console device by using an LED screen-driven menu and/or a wirelessly connected computing device with an external software application. The LED screen-driven menu provides instant feedback during the programming session or during normal use, and wireless feedback to a connected computing device. The LED screen-driven menu and the wirelessly-connected computing device may include a "READY" LED to provide information on whether the device is in a "home" state or a "ready" state, and an "ERROR" LED to provide a user with feedback on conditions. The LED screen driven menu may further include items related to PINs and door designator references. The present invention also provides an easily ascertainable indication of the health and the condition of the intelligent keypad, visible through the LED screen or the external software application on the wirelessly connected device. A user can easily program the same PIN for multiple doors using the same console device, program multiple PINs for a single door, and create a separate temporary PIN for one or more doors.

The present invention further provides a barcode scanner and a motion-detection infrared camera with biometric facial recognition features to provide additional entry methods to users. A user can wirelessly upload any tracking numbers from any Internet purchase directly to the intelligent secure keyless console device to allow secure delivery using the barcode scanner on the intelligent secure keyless console device. Scanning the barcode of a package that matches an uploaded tracking number results in the opening of the garage door, the closing of the garage door after a certain amount of time has passed, and instant confirmation of the opening of the garage door, the closing of the garage door, and the delivery of the package relayed wirelessly to the connected computing device. This aspect of the present invention advantageously provides for a significant decrease in the likelihood of a package getting stolen when said package is delivered to a home when no one is around to bring it in.

While prior systems (see Scalisi 2018, US 2018/0075681 A1) scan barcode information by taking a picture and parsing the image for a barcode to scan and compare to stored barcodes, the present invention comprises a dedicated barcode scanner. The use of a dedicated barcode scanner provides the system with a more simple and energy efficient method of barcode scanning due to the lower number of necessary computations.

The present invention further provides biometric facial recognition to allow family and friends to easily access the premises with instant confirmation of the entry relayed to the external software application. The infrared camera can also act as a security camera with motion detection and live video feed of the front of the property.

One of the unique and inventive technical features of the present invention is the use of a dedicated barcode scanner for the purpose of secure package delivery. Without wishing to limit the invention to any theory or mechanism, it is believed that the technical feature of the present invention advantageously provides for a secure, efficient, and simple way for packages to be delivered to the interior of a home without the need for a person to be home to receive the package. None of the presently known prior references or work has the unique inventive technical feature of the present invention. Furthermore, the use of a dedicated barcode scanner for the purpose of secure package delivery is counterintuitive. The reason that it is counterintuitive is because the prior references teach away from the present invention. For example, Scalisi 2018, US 2018/0075681 A1 teaches the use of a camera to take a picture of a package and parse the picture for a barcode to scan, while the present invention simply scans that barcode directly from the package.

Another one of the unique and inventive technical features of the present invention is the implementation of the garage door unit with the console device for actuating the garage door control system such that only the methods provided by the console device are able to open the garage door. Without wishing to limit the invention to any theory or mechanism, it is believed that the technical feature of the present invention advantageously provides for completely secure garage door control with far reduced opportunity for hacking or unintended actuation when compared to prior systems for garage door control. None of the presently known prior references or work has the unique inventive technical feature of the present invention.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE SEVERAL VIEWS OF THE DRAWING(S)

The features and advantages of the present invention will become apparent from a consideration of the following detailed description presented in connection with the accompanying drawings in which.

DETAILED DESCRIPTION OF THE INVENTION

Figure 1:
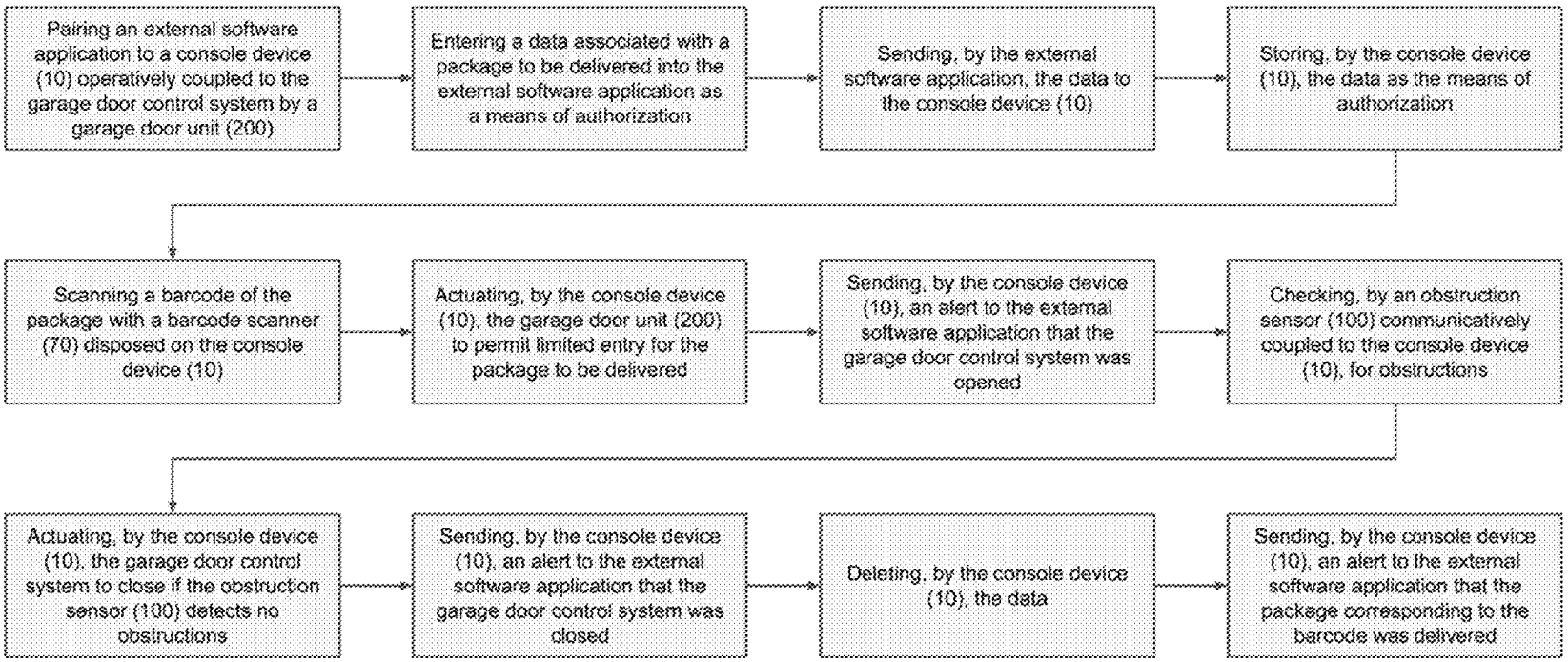
FIG. 1 shows a method of the present invention for using a console device to authorize a motorized entry system to permit entry through the use of a barcode transmitted from an external software application.

Following is a list of elements corresponding to a particular element referred to herein:

10 console device
12 weather-proof housing for console device
20 frontal camera
30 side camera
40 microphone-speaker
50 LED screen
60 backlight keypad
70 barcode scanner
80 cover with solar cell
90 processor
92 memory device
94 transmitter/receiver
96 RAM device
100 obstruction sensor
200 garage door unit Referring to FIG. 1, the present invention features a method for intelligent secure keyless authorization for package delivery for a motorized entry system through the use of an external software application. In some embodiments, the method may comprise integrating a console device (10) into a motorized entry system and communicatively coupling the external software application with the console device (10). From the external software device, data of an incoming package may be entered as a means of authorization. The external software application may then send the data to the console device (10) where it will be stored as a means of authorization. When a barcode of the package is scanned by a barcode scanner (70) disposed on the console device (10), the console device (10) checks if the scanned barcode corresponds to the data and actuates the motorized entry system to permit entry for the package to be delivered if a match is found. A person delivering the package may then place the package indoors. The console device (10) may send an alert to the external software application that the motorized entry system was opened. The method may further comprise an obstruction sensor (100) checking for obstructions in the closing path of the motorized entry system on a fixed interval. If a check is completed and no obstructions are detected by the obstruction sensor (100), the console device (10) may actuate the motorized entry system to close. The console device (10) may send an alert to the external software application that the motorized entry system was closed. The method may further comprise deleting the matched barcode as a means of authorization, and sending an alert to the external software application that the package corresponding to the barcode was delivered. In some embodiments, the console device (10) communicates with the external software application through the use of WiFi and Bluetooth Low Energy connections. In some embodiments, the data received by the console device (10) is a tracking number. In some embodiments, the fixed interval of obstruction sensor (100) checks is every 30 to 90 seconds.

Figure 2:
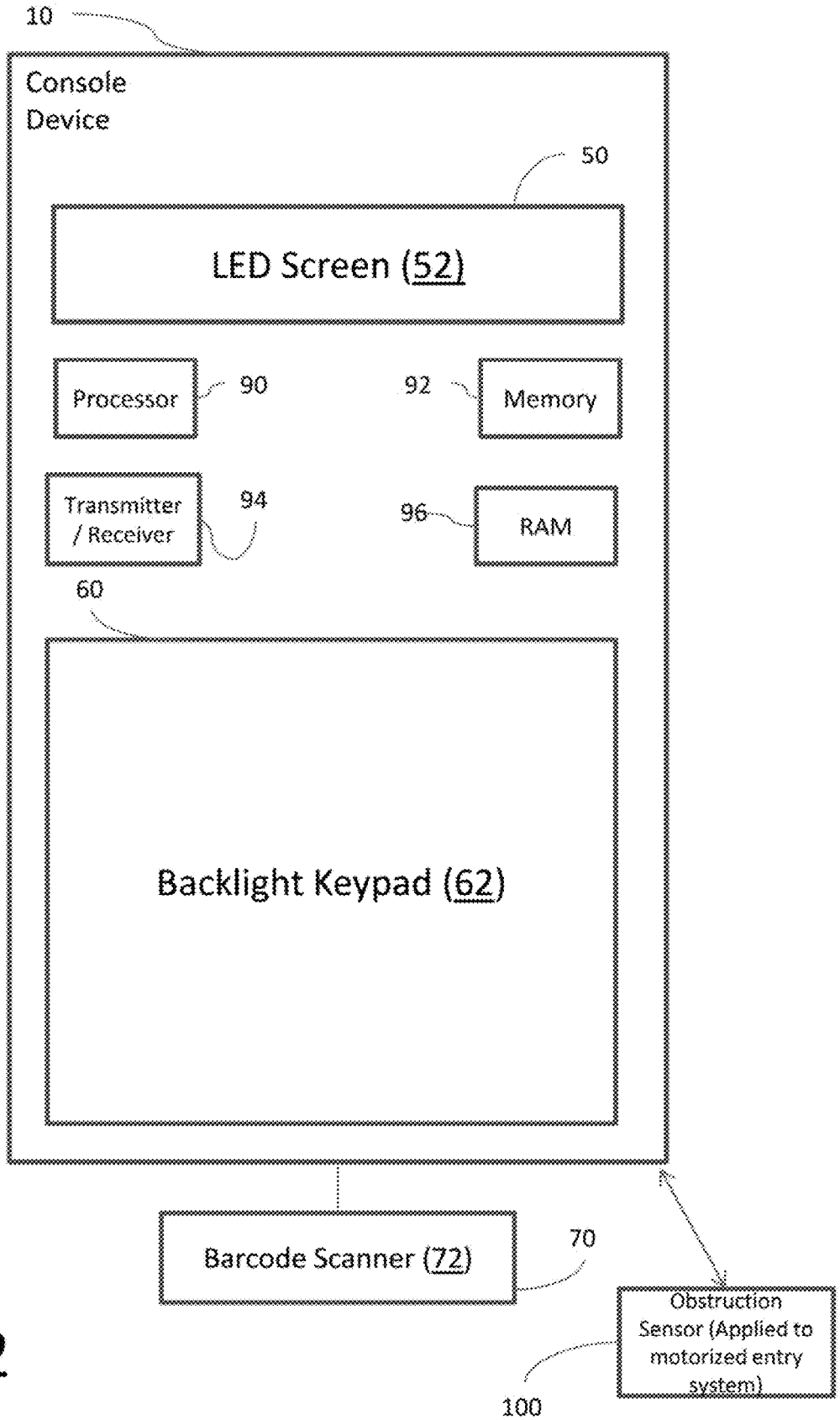
FIG. 2 shows a system of the present invention for using a console device to authorize a motorized entry system to permit entry through the use of a barcode transmitted from an external software application.
Figure 3:
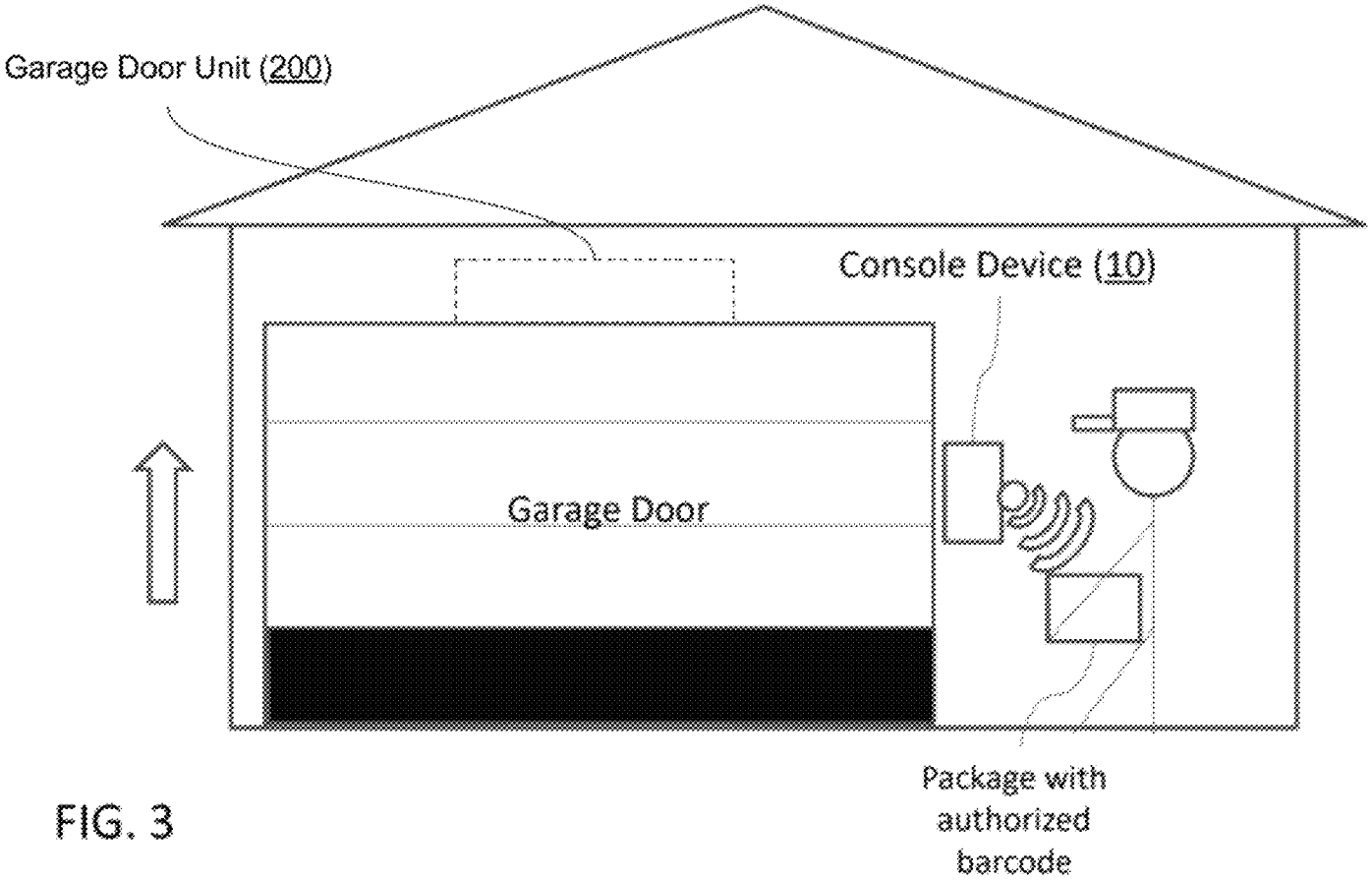
FIG. 3 shows a diagram of how a delivery driver may use the present invention to scan a barcode on a package and authorize the console device to permit entry for the package to be delivered inside.

Referring to FIG. 2, the present invention features a system for intelligent secure keyless authorization for package delivery through the use of an external software application. In some embodiments, the system may comprise a console device (10). The console device (10) may comprise an LED screen (50), a backlight keypad (60), a barcode scanner (70), a processor (90), a RAM device (96), a memory device (92), and a transmitter/receiver device (94). The processor (90) may be capable of executing computer-readable instructions stored in the memory device (92), and the memory device (92) may store data and computer-readable instructions for comparing data to a barcode and actuating a motorized entry system to permit entry. The transmitter/receiver device (94) may communicate with a home network, and use the home network to communicate with the external software application.

In some embodiments, the system of the present invention may further comprise the console device (10) being integrated into the motorized entry system and communicatively coupled to the external software application through the use of the transmitter/receiver device (94). The console device (10) may be communicatively coupled to an obstruction sensor (100) disposed on the motorized entry system. A user may input data for a package that has yet to arrive into the external software application, which will then send the data to the console device (10). The console device (10) may then receive the data through the use of the transmitter/receiver device (94). From the transmitter/receiver device (94), the data is stored in the memory device (92). The barcode scanner (70) may scan a barcode from a package being delivered and transmit the scanned barcode to the processor (90). The processor (90) may accept the barcode from the barcode scanner (70) and execute computer-readable instructions stored in the memory device (92) to compare the scanned barcode to the data stored in the memory device (92). Upon finding a match between the scanned barcode information and the data, the processor (90) actuates the motorized entry system to permit entry and marks the stored data as matched. The transmitter/receiver (94) device may then send an alert to the external software application to notify that the motorized entry system was opened.

In some embodiments, the obstruction sensor (100) may begin checking for obstructions in the closing path of the motorized entry system on a fixed interval. If a check is passed and the obstruction sensor (100) does not detect any obstructions in the closing path, the obstruction sensor (100) may actuate the processor (94) of the console device (10) to close the motorized entry system. The transmitter/receiver device (94) may send an alert to the external software application that the motorized entry system was closed. The data is then deleted from the memory device (92) and the transmitter/receiver (94) device may send an alert to the external software application to notify that the package corresponding to the data was delivered. In some embodiments, the transmitter/receiver (94) device is configured to communicate through Bluetooth Low Energy (BLE) and WiFi, and the data inputted into the external software device and sent to the console device (10) may be a tracking number. In some embodiments, the fixed interval of the obstruction sensor (100) checks may be every 30 to 90 seconds.

Figure 4:
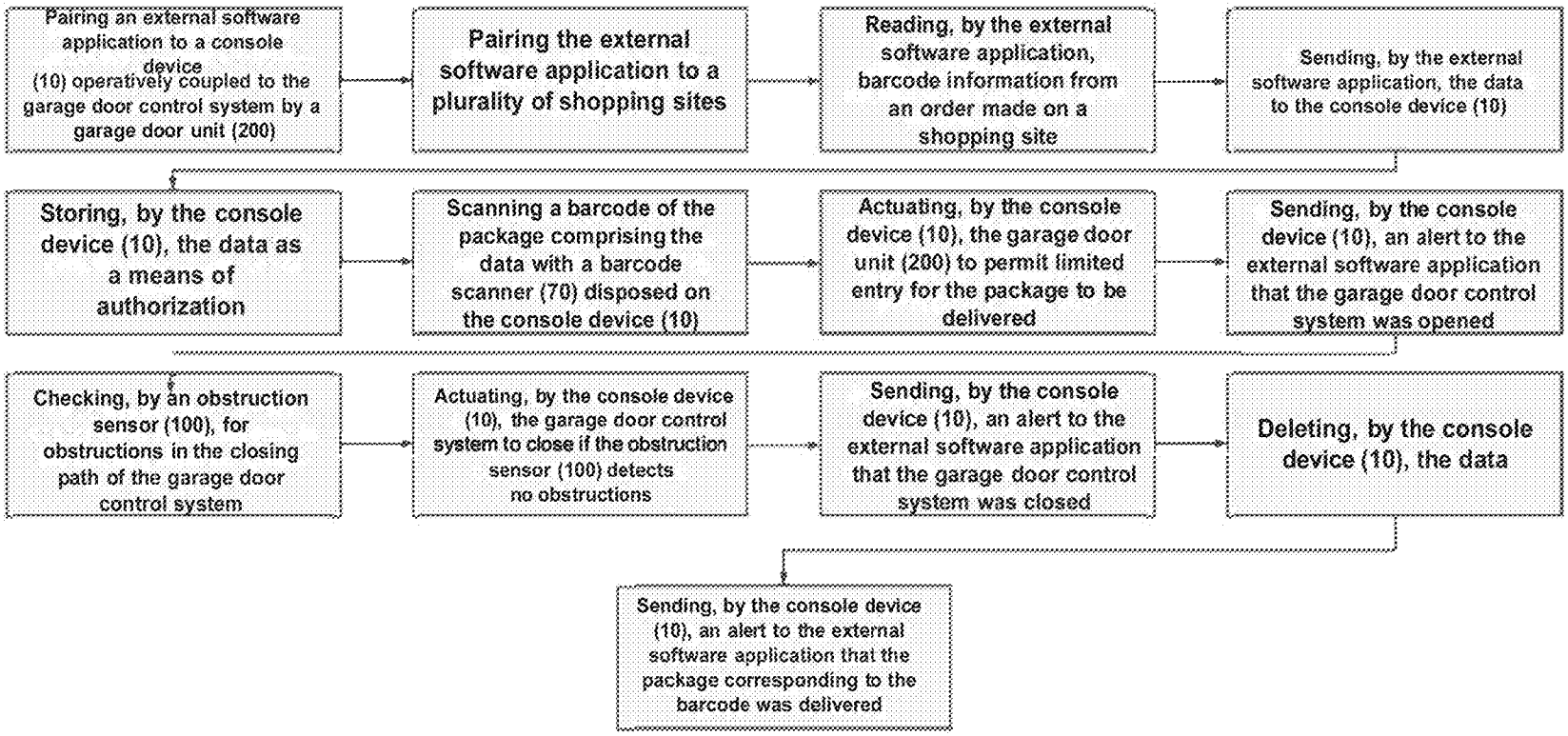
FIG. 4 shows a method of the present invention for using a console device to authorize a motorized entry system to permit entry through the use of a barcode automatically transmitted from an external software application, the external software application being linked to a plurality of shopping sites.
Figure 5A:
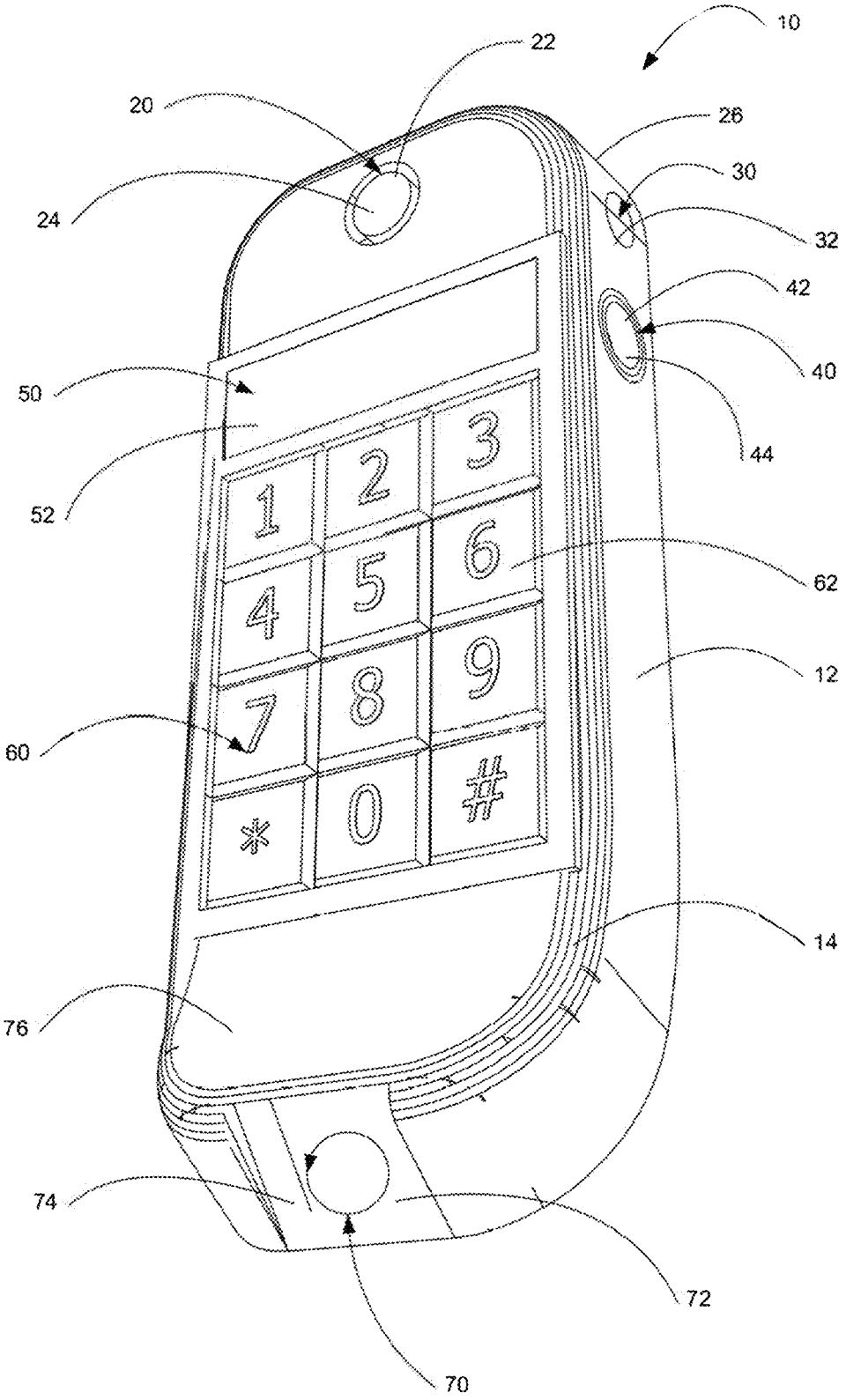
FIG. 5A shows a perspective view of a preferred embodiment of a keyless intelligent secure wall console device of the present invention.
Figure 5B:
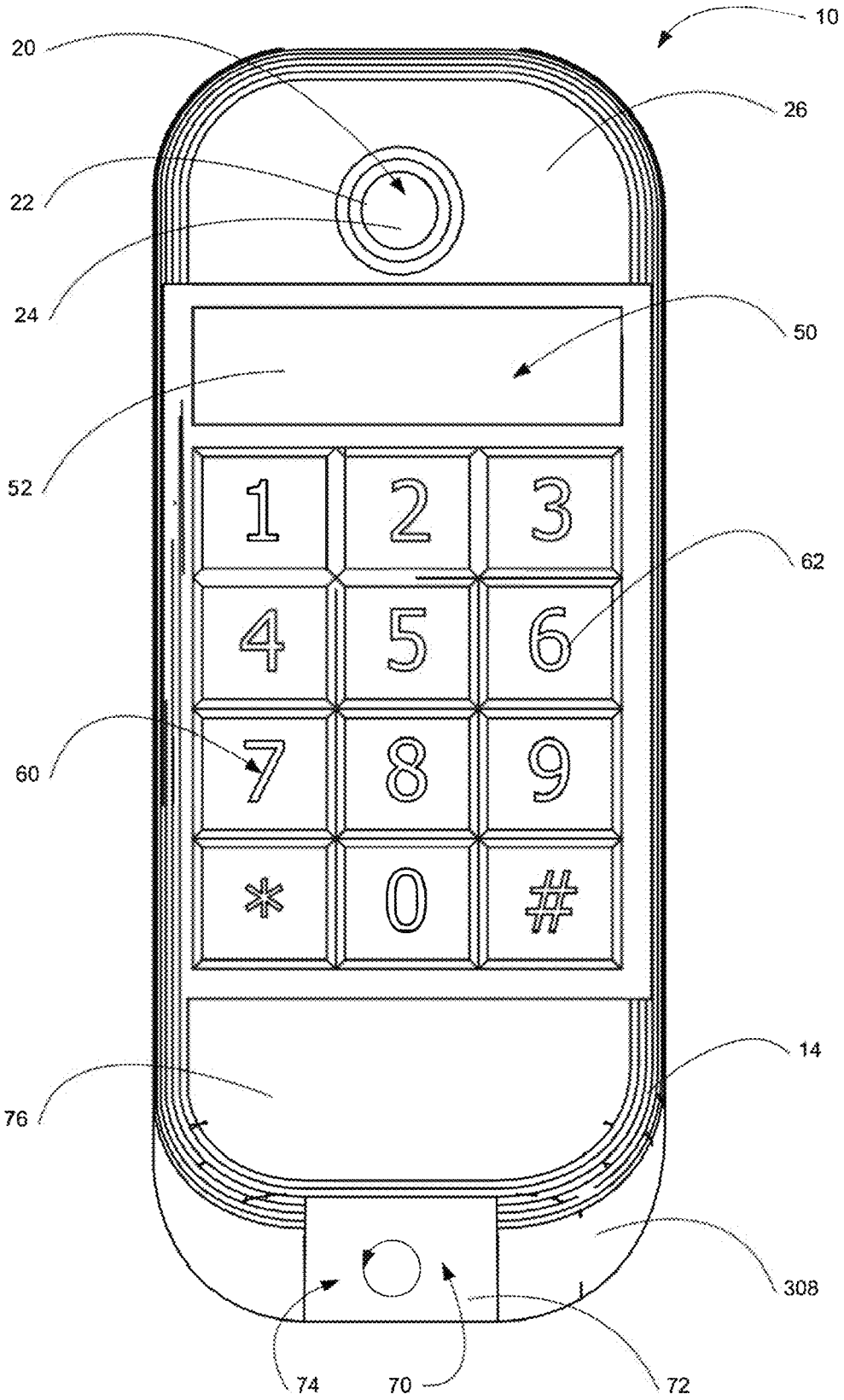
FIG. 5B shows a perspective front view of a panel of the keyless intelligent secure wall console device of the present invention.
Figure 5C:
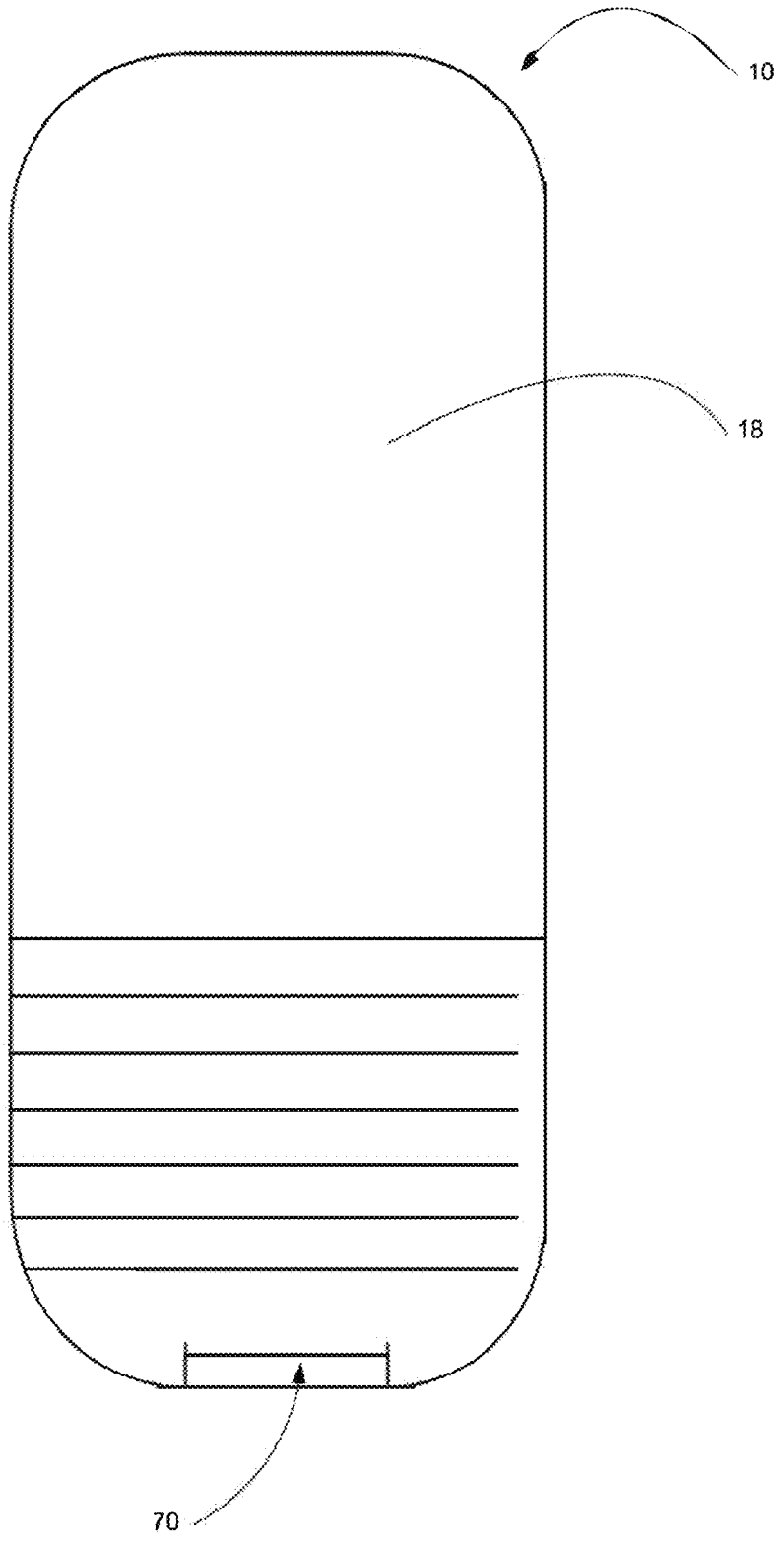
FIG. 5C shows a perspective Back view of panel of the keyless intelligent secure wall console device of the present invention.
Figure 5D:
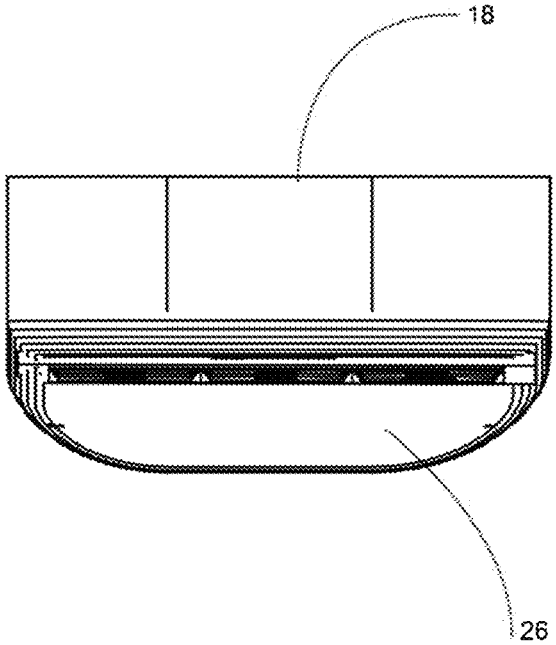
FIG. 5D shows a perspective Top view of panel of the keyless intelligent secure wall console device of the present invention.
Figure 5E:
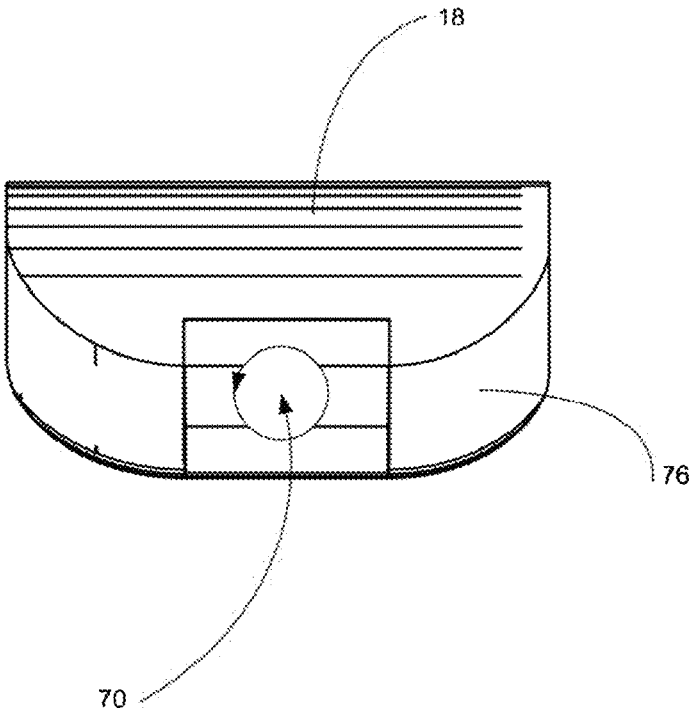
FIG. 5E shows a perspective Bottom view of panel of the keyless intelligent secure wall console device of the present invention.
Figure 5F:
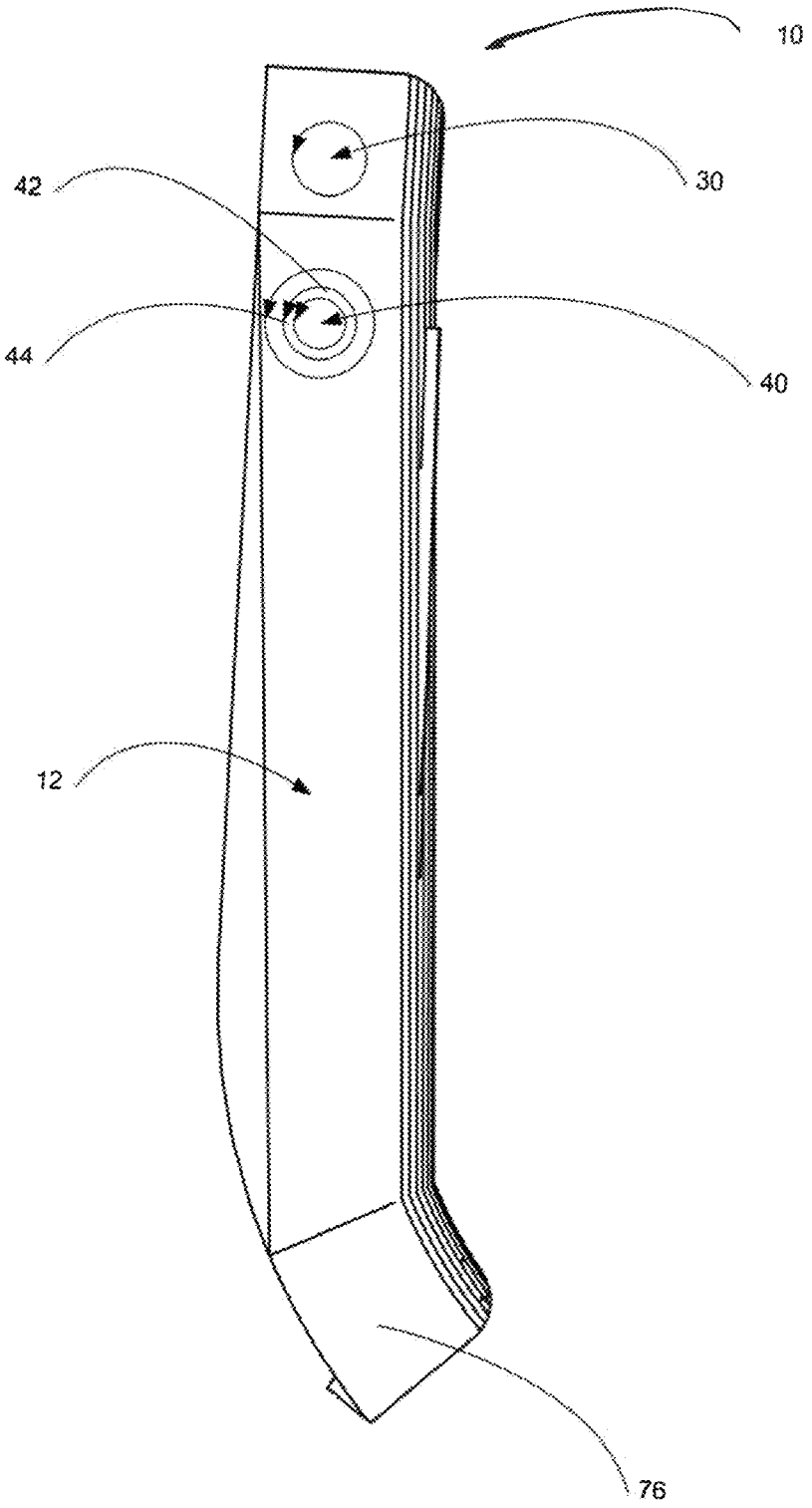
FIG. 5F shows a perspective Left side view of panel of the keyless intelligent secure wall console device of the present invention.
Figure 5G:
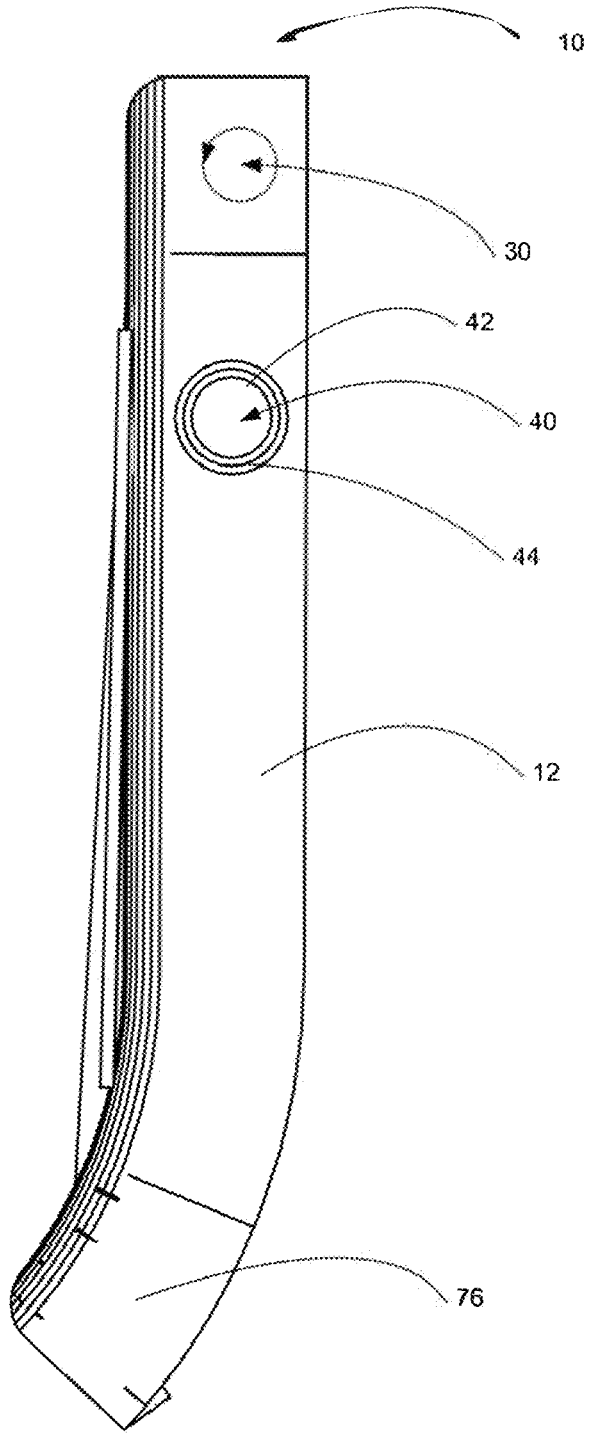
FIG. 5G shows a perspective Right-side view of panel of the keyless intelligent secure wall console device of the present invention.
Figure 5H:
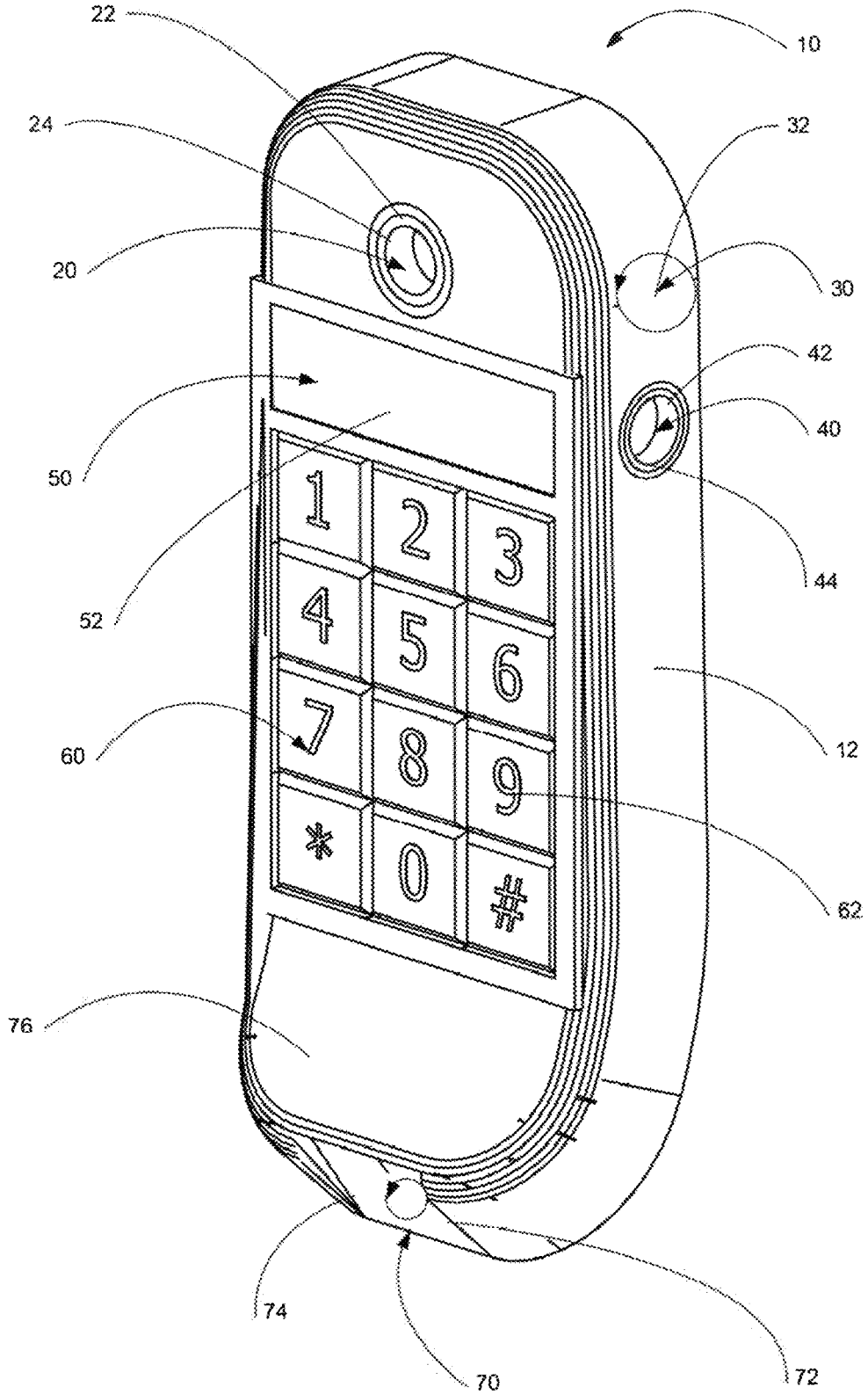
FIG. 5H shows a perspective ISO view of panel of the keyless intelligent secure wall console device of the present invention.
Figure 5I:
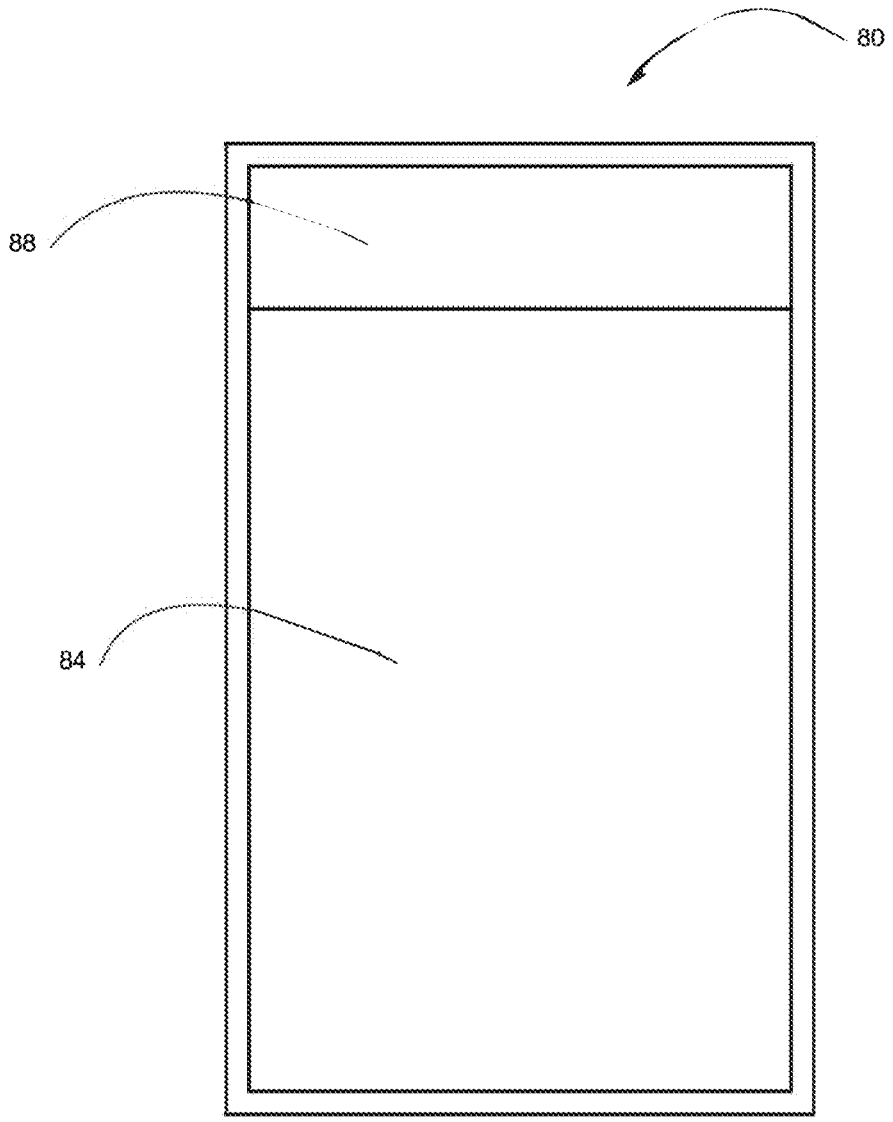
FIG. 5I shows a perspective front cover view of panel of the keyless intelligent secure wall console device of the present invention.
Figure 5J:
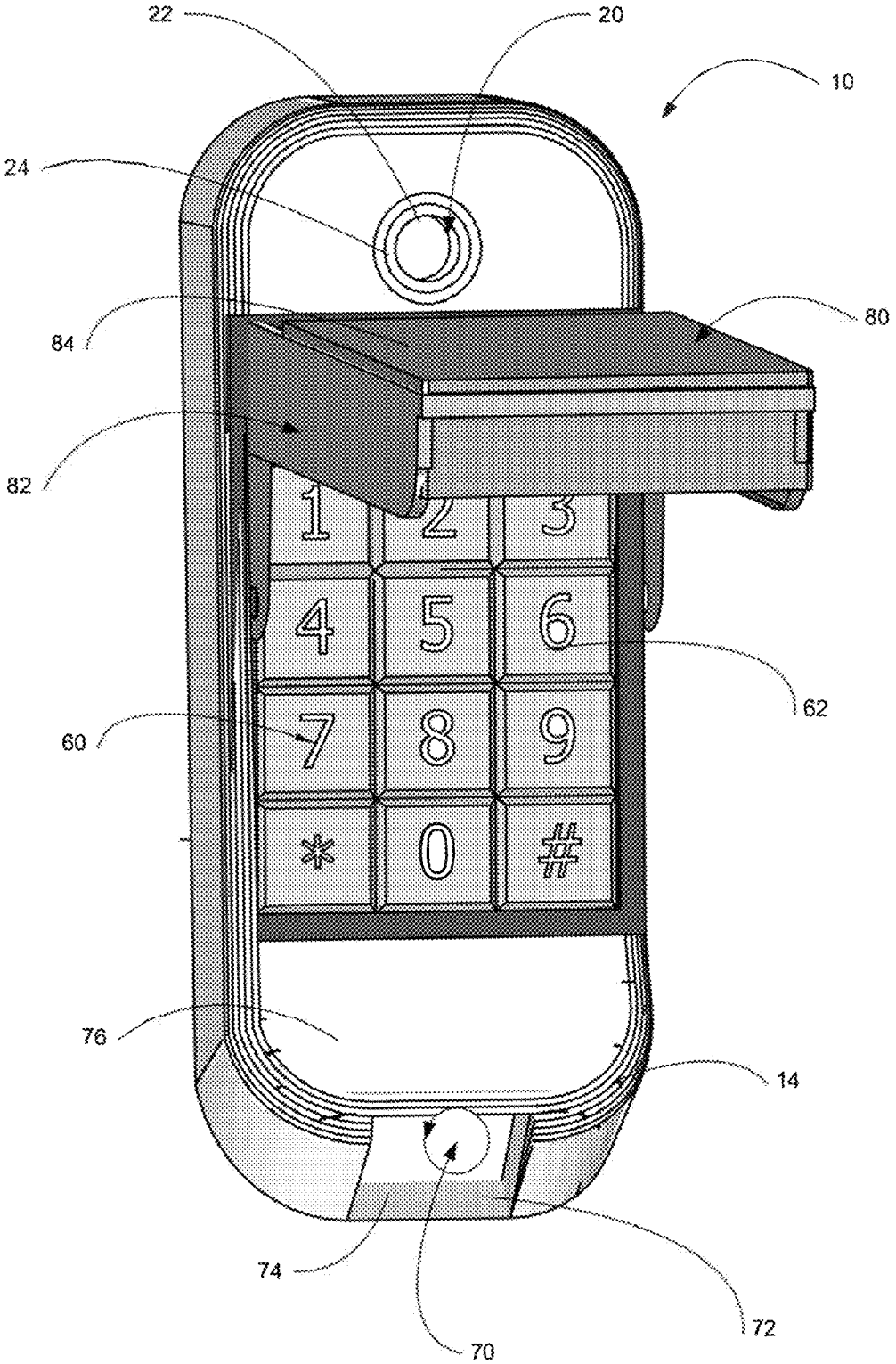
FIG. 5J shows a perspective ISO with a cover view of a panel of the keyless Intelligent secure wall console device of the present invention.

Referring to FIG. 4, the present invention features a method for intelligent secure keyless authorization for package delivery for a motorized entry system through the use of an external software application. In some embodiments, the method may comprise integrating a console device (10) into a motorized entry system and communicatively coupling the external software application with the console device (10). The external software application may then be linked to a plurality of shopping sites such that data from an order made on a shopping site from the plurality of paired shopping sites is automatically uploaded to the external software application and sent to the console device (10). The data may then be stored by the console device (10). When a barcode of the package is scanned by a barcode scanner (70) disposed on the console device (10), the console device (10) checks if the scanned barcode corresponds to the data and actuates the motorized entry system to permit limited entry for the package to be delivered if a match is found. A person delivering the package may then place the package indoors. The console device (10) may send an alert to the external software application that the motorized entry system was opened.

In some embodiments, the method may further comprise an obstruction sensor (100) checking for obstructions in the closing path of the motorized entry system on a fixed interval. If a check is completed and no obstructions are detected by the obstruction sensor (100), the console device (10) may actuate the motorized entry system to close. The console device (10) may send an alert to the external software application that the motorized entry system was closed. The method may further comprise deleting the matched barcode as a means of authorization, and sending an alert to the external software application that the package corresponding to the data was delivered. In some embodiments, the console device (10) communicates with the external software application through the use of WiFi and Bluetooth Low Energy connections. In some embodiments, the data received by the console device (10) is a tracking number. In some embodiments, the fixed interval of obstruction sensor (100) checks is every 30 to 90 seconds.

Referring now to FIGS. 5A-5J, the present invention features a device (10) for intelligent secure keyless authorization for package delivery for a motorized entry system. The device (10) may comprise a weather-proof housing (12), a front camera (20), a side camera (30) on either side of the device (10), a microphone-speaker (40), an LED screen (50), a backlight keypad (60), a barcode scanner (70), and a cover (80) for the backlight keypad (60). In some embodiments, the front camera (20) may be a motion-detection facial-recognition camera. In some embodiments, the front camera (20) may be used for scanning faces as a means of authorization for the motorized entry system to permit entry. The console device (10) may store face information received from the external software application and compare scanned faces to stored faces as a means of authorization. In other embodiments, the front camera (20) may be used for conference calls between the console device (10) and the external software application. The microphone-speaker (40) may be used to transmit and receive audio, and the front camera (20) may be used to transmit video. In other embodiments still, the front camera (20) may be used for security through the use of motion detection. The front camera (20) may take pictures when motion is detected and send an alert to the external software application.

In some embodiments, the side camera(s) (30) may also be used for security through the use of motion detection through the same method as the front camera (20). The microphone-speaker (40) may be used to detect noises above a certain threshold and send an alert to the external software application if one such noise is detected. In some embodiments, the LED screen (50) may be used to display information relevant to a user of the console device (10). The displayed information may comprise error codes if an error in the motorized entry system or the console device (10) is detected, directions for initializing PIN authorization, directions for authorizing based on facial recognition, directions for authorizing based on barcode scanning, and the state that the console device (10) is currently in (security, default, etc), In some embodiments, the backlight keypad (60) may comprise digit keys (0-9) and an ENTER key. In some embodiments, the digit keys may be used to initialize PIN authorization from the console device (10). The ENTER key may be used to confirm PIN authorization and select an option. In some embodiments, the barcode scanner (70) may be used to scan barcodes of packages as a means of authorization for the console device (10). In some embodiments, the cover (80) may comprise a solar cell (82) that may generate a DC current to charge the console device (10) when the cover (80) is in a closed position in order to keep the console device (10) fully charged without requiring the batteries to be changed.

An external software application may be installed onto a computing device (laptop, desktop computer, mobile phone, etc) and communicatively coupled to a console device (10) integrated into a motorized entry system. The computing device may connect to a home network and the console device (10) may connect to the same home network. The external software application may use the home network to communicate with the external software application and vice-versa. The external software application may comprise an option to set at least one PIN as a method of authorization for the console device (10) by accepting at least one PIN as input from a user and transmitting the entered PIN(s) to the console device (10). The external software application may further comprise an option to set a face as a method of authorization by scanning the user's face and sending facial recognition information to the console device (10). The external software application may further comprise an option to directly authorize the console device (10) to actuate the motorized entry system and permit entry. The external software application may further comprise an option to set a barcode of a package as a method of authorization for the console device (10) by accepting tracking numbers from the user as input and transmitting the tracking numbers to the console device (10). The external software application may further comprise links to a plurality of shopping sites, wherein tracking numbers of orders made on a shopping site of the plurality of shopping sites are automatically read by the external software application and transmitted to the console device (10) as a means of authorization.

The present invention may be directed to a method for intelligent secure keyless authorization for package delivery for a garage door control system. In some embodiments, the method may comprise pairing an external software application to a console device (10) operatively coupled to the garage door control system by a garage door unit (200) through a communicative connection. The method may further comprise entering data associated with a package to be delivered into the external software application as a means of authorization, sending, by the external software application, the data to the console device (10), and storing, by the console device (10), the data as the means of authorization. The method may further comprise scanning the package's barcode with a barcode scanner (70) disposed on the console device (10). In some embodiments, the barcode may comprise the data. The method may further comprise actuating, by the console device (10), the garage door unit (200) to permit limited entry for the package to be delivered. In some embodiments, the limited entry may comprise partially opening a garage door of the garage door control system to allow only the package to pass under the garage door.

The method may further comprise sending, by the console device, an alert to the external software application that the garage door control system was opened. The method may further comprise checking, by an obstruction sensor (100) communicatively coupled to the console device (10), for obstructions in the closing path of the garage door control system on a fixed interval. The method may further comprise actuating, by the console device (10), the garage door control system to close if the obstruction sensor (100) detects no obstructions while checking. The method may further comprise sending, by the console device (10), an alert to the external software application that the garage door control system was closed, deleting, by the console device (10), the data, and sending, by the console device (10), an alert to the external software application that the package corresponding to the barcode was delivered. If the barcode of the package does not comprise the data, the garage door control system may not be actuated. In some embodiments, the console device (10) may communicate with the external software application through the use of WiFi and Bluetooth Low Energy connections. The data may be a tracking number. The fixed interval may be 30 to 90 seconds.

The present invention features a system for intelligent secure keyless authorization for package delivery for a garage door control system through the use of an external software application. In some embodiments, the system may comprise a console device (10)/The console device may comprise an LED screen (50), a backlight keypad (60), a barcode scanner (70), a processor (90), a RAM device (96), a memory device (92), and a transmitter/receiver device (94). In some embodiments, the memory device (92) may store data and computer-readable instructions for comparing a barcode to data and actuating a garage door control system. The processor (90) may execute computer-readable instructions stored in the memory device (92). The transmitter/receiver device (94) may communicate with a home network and may communicate with the external software application through the home network. The system may further comprise an obstruction sensor (100) communicatively coupled to the console device (10) and a garage door unit (200) operatively coupled to the garage door control system and the console device (100).

In some embodiments, the console device (10) may be integrated into the garage door control system. The console device (10) may be coupled communicatively to the external software application and the console device (10) may be coupled communicatively to the obstruction sensor (100). The transmitter/receiver device (94) may accept a data of a package from the external software application and may communicate with the memory device (82) to store the data. The barcode scanner (70) may scan a barcode from a package and transmit the scanned barcode information to the processor (90). The processor (90) may accept barcode information from the barcode scanner (72) and may execute computer-readable instructions stored in the memory device (92) to compare the scanned barcode information to the data (92). If the scanned barcode information corresponds to the data, the processor may execute computer-readable instructions to actuate the garage door control system to permit entry. The transmitter/receiver (94) device may send a notification to the external software application that the garage door control system has opened. If the garage door control system is open, the obstructions sensor (100) may scan for obstructions in a closing path of the garage door control system at a fixed interval. If no obstructions are detected in the closing path, the obstruction sensor (100) may actuate the console device (10) to actuate the garage door control system to close. The transmitter/receiver (94) device may send a notification to the external software application that the garage door control system was closed. The data may be deleted from the memory device (92) after being used to authorize entry and the transmitter/receiver (94) device may send a notification to the external software application that the package corresponding to the matched barcode was delivered. In some embodiments, the console device (10) may communicate with the external software application through the use of WiFi and Bluetooth Low Energy connections. The data may be a tracking number. The fixed interval may be 30 to 90 seconds.

The present invention may feature a method for intelligent secure keyless authorization for package delivery for a garage door control system. In some embodiments, the method may comprise pairing an external software application to a console device (10) operatively coupled to the garage door control system by a garage door unit (200) through a communicative connection. The garage door control system may have a receiver disposed within to allow for the communicative connection. In some embodiments, the garage door unit (200) acts as the receiver for commands from the console device (10). The receiver may communicate via an RF or Bluetooth signal. In some embodiments, the receiver may comprise a Relay RF, a Bluetooth emitter/receiver, or a combination thereof. In some embodiments, the receiver may comprise an Ultrasonic Module HC-SR04 Distance Measuring Ranging Transducers Sensor with camera. The method may further comprise pairing the external software application to a plurality of shopping sites, reading, by the external software application, barcode information from an order made on a shopping site from the plurality of paired shopping sites, sending, by the external software application, the data to the console device (10), storing, by the console device (10), the data as a means of authorization, and scanning a barcode of the package may comprise the data with a barcode scanner (70) disposed on the console device (10). The method may further comprise actuating, by the console device (10), the garage door unit (200) to permit limited entry for the package to be delivered. The limited entry may comprise partially opening a garage door of the garage door control system to allow only the package to pass under the garage door.

The method may further comprise sending, by the console device (10), an alert to the external software application that the garage door control system was opened, checking, by an obstruction sensor (100), for obstructions in the closing path of the garage door control system on a fixed interval, and actuating, by the console device (10), the garage door control system to close if the obstruction sensor (100) detects no obstructions while checking. The method may further comprise sending, by the console device (10), an alert to the external software application that the garage door control system was closed, deleting, by the console device (10), the data, and sending, by the console device (10), an alert to the external software application that the package corresponding to the barcode was delivered. If the barcode of the package does not comprise the data, the garage door control system may not be actuated. In some embodiments, the console device (10) may communicate with the external software application through the use of WiFi and Bluetooth Low Energy connections. The data may be a tracking number. The fixed interval may be 30 to 90 seconds.

In some embodiments, the present invention may be capable of generating a one-time code for a user to use to actuate the garage door control system. This one-time code may be generated by the pin pad of the console device or the external software application. Upon entering the one-time code into the console device, the camera may take a picture capturing the face of the person entering the code. This picture may be sent to the external software application for the user to confirm the identity of the user. Upon successfully entering the one-time code, the code may be discarded and no longer be available as a means of authorization. In some-embodiments, the console device (10) may be the only method of opening the garage door control system. In some embodiments, the console device (10) may be capable of accepting as a means of authorization a numeric code, a password, an authorized facial identification scan, an authorized fingerprint, or a combination thereof.

In some embodiments, the console device (10) may be operatively connected to the garage door unit (200) by a WiFi connection. If a WiFi connection is unavailable, the console device (10) may be operatively connected to the garage door unit (200) by an RF connection. The garage door unit (200) may comprise a storage component for storing data. The storage component may be an SD card. In the case of a WiFi connection being unavailable, and thus disconnecting the console device (10) from the external software application, the console device (10) may transmit data (i.e. barcodes, photos, biometrics, etc.) to the garage door unit (200) by the RF connection to be stored in the storage component. When a WiFi connection becomes available again, all data stored in the storage component may be synced to the external software application. This allows for the present invention to operate with no downtime or interruptions even in the case of an Internet outage. Because of this, the RF connection is considered more reliable and secured than the WiFi connection.

In some embodiments, the memory component of the control device (10) may be capable of executing, by a camera (20), a facial identification scan. This may involve taking an initial photograph of one or more faces, processing the one or more faces into data to be used as one or more means of authorization, taking a second photograph of a face, processing the face into data, and comparing the data to the registered means of authorization. If the face matches, then the garage door unit (200) may actuate the garage door control system and the external software application may be notified. The facial recognition is to allow family members and especially the kids access to the property without keys, since kids most likely will misplace the keys or lose them, the notification system will give the parents the peace of mind that the kids arrived home and are at home safe. If the face does not match, then the garage door will not be opened and the external software application may be notified. This may allow for the user to report the authorities of a potential intruder that tried to enter the premises with a picture of the culprit.

In some embodiments, the present invention may obviate the need for a garage door opener in the car as well as the need to program the rear view mirror to open the garage. The external software application and the console device (10) are capable of actuating the garage door control system and opening the garage door on its own. This prevents thieves from gaining access to homes through the garage by using a garage door clicker left in the car or by using the rear view mirror even when the car is not running.

In some embodiments, the console device (10) may use the camera (20) to take a picture while a barcode is being scanned as a package is being delivered. This picture may include a face of the delivery person delivering the package. This picture may then be sent from the console device (10) to the external software application for review by the user. If anything happens to the package (e.g. it is not delivered, the package is damaged, etc.), they will be able to identify the delivery person responsible for the package and notify the source of the package or the delivery service of who should be held accountable.

In some embodiments, the camera (20) may detect a person approaching the console device (10) and initiate communication with the external software application. This communication may comprise audio communication (by the microphone-speaker (40)) or audio-video communication (by the microphone-speaker (40) and the camera (20)). This may allow for the user to confront potential intruders or unwanted individuals to scare them off, or to identify a known visitor without needing to go to the door.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting essentially of" or "consisting of", and as such the written description requirement for claiming one or more embodiments of the present invention using the phrase "consisting essentially of" or "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A method for intelligent secure keyless authorization for package delivery for a garage door control system, the method comprising:

a. pairing an external software application to a console device (10) operatively coupled to the garage door control system by a garage door unit (200) through a communicative connection;

b. entering a data associated with a package to be delivered into the external software application as a means of authorization;

c. sending, by the external software application, the data to the console device (10);

d. storing, by the console device (10), the data as the means of authorization;

e. setting, by the external software application, a face as another means of authorization for actuating the garage door control system by scanning a user's face using at least one camera (20) disposed on the console device (10), and sending facial recognition information to the console device (10);

f. scanning a barcode of the package with a barcode scanner (70) disposed on the console device (10), the barcode comprising the data, the barcode scanner (70) scanning the barcode directly without taking a picture of the barcode using a camera and then parsing the picture for determining the barcode;

g. actuating, by the console device (10), the garage door unit (200) to permit limited entry for the package to be delivered, the limited entry comprising partially opening a garage door of the garage door control system to allow only the package to pass under the garage door;

h. sending, by the console device (10), an alert to the external software application that the garage door control system was opened;

i. checking, by an obstruction sensor (100) communicatively coupled to the console device (10), for obstructions in the closing path of the garage door control system on a fixed interval;

j. actuating, by the console device (10), the garage door control system to close if the obstruction sensor (100) detects no obstructions while checking;

k. sending, by the console device (10), an alert to the external software application that the garage door control system was closed;

l. deleting, by the console device (10), the data; and m. sending, by the console device (10), an alert to the external software application that the package corresponding to the barcode was delivered;

wherein, if the barcode of the package does not comprise the data, the garage door control system is not actuated;

wherein the console device (10) comprises a housing with a displaceable cover (80), the displaceable cover (80) moveable between an open position and a closed position, wherein the barcode scanner (70) and the at least one camera (20) are at least partially circumscribed by the housing of the console device (10), and wherein at least a portion of the displaceable cover (80) is disposed between the barcode scanner (70) and the at least one camera (20);

wherein the console device (10) further comprises a solar cell (82) disposed on the displaceable cover (80), and wherein the solar cell (82) generates power to charge the console device (10) when the displaceable cover (80) is in the closed position;

wherein the console device (10) is configured to be connected to the garage door unit (200) by both a WiFi connection and an RF connection, wherein the console device (10) is operatively connected to the garage door unit (200) by the WiFi connection when the WiFi connection is available, wherein, if the WiFi connection is unavailable, the console device (10) is operatively connected to the garage door unit (200) by the RF connection; and wherein the garage door unit (200) comprises a storage component for storing data, wherein, if the WiFi connection is unavailable, the console device (10) transmits data to the garage door unit (200) by the RF connection to be stored in the storage component, wherein, if the WiFi connection is available, all data stored in the storage component is synced to the external software application.

2. The method of claim 1, wherein the console device (10) communicates with the external software application through the use of WiFi and Bluetooth Low Energy connections.

3. The method of claim 1, wherein the data is a tracking number.

4. The method of claim 1, wherein the fixed interval is 30 to 90 seconds.

5. The method of claim 1, wherein the garage door control system can only be actuated by the console device (10).

6. The method of claim 1, wherein the console device (10) is capable of accepting as a further means of authorization a numeric code, a password, an authorized fingerprint, or a combination thereof.

7. The method of claim 1, wherein the garage door unit (200) comprises a camera.

8. The method of claim 1, wherein the garage door unit (200) comprises a distance sensor.

9. A system for intelligent secure keyless authorization for package delivery for a garage door control system through the use of an external software application, the system comprising:

a. a console device (10), the console device comprising:
i. an LED screen (50),
ii. a backlight keypad (60),
iii. a barcode scanner (70),
iv. a processor (90),
v. a RAM device (96),
vi. a memory device (92),
vii. a transmitter/receiver device (94),
viii. at least one camera (20),
ix. a housing (12) with a displaceable cover (80), and
x. a solar cell (82) disposed on the displaceable cover (80),
wherein the LED screen (50), the backlight keypad (60), the barcode scanner (70), and the at least one camera (20) are at least partially circumscribed by the housing of the console device (10), the displaceable cover (80) is moveable between an open position and a closed position, and at least a portion of the displaceable cover (80) is disposed between the barcode scanner (70) and the at least one camera (20),
wherein the solar cell (82) generates power to charge the console device (10) when the displaceable cover (80) is in the closed position,
wherein the memory device (92) stores data and computer-readable instructions for comparing a barcode to a data and actuating a garage door control system,
wherein the processor (90) executes computer-readable instructions stored in the memory device (92),
wherein the transmitter/receiver device (94) communicates with a home network, and
wherein the transmitter/receiver device (94) communicates with the external software application through the home network;

b. an obstruction sensor (100) communicatively coupled to the console device (10); and c. a garage door unit (200) comprising a storage component operatively coupled to the garage door control system and the console device (10);
wherein the console device (10) is configured to be connected to the garage door unit (200) by both a WiFi connection and an RF connection, wherein the console device (10) is operatively connected to the garage door unit (200) by the WiFi connection when the WiFi connection is available, wherein, if the WiFi connection is unavailable, the console device (10) is operatively connected to the garage door unit (200) by the RF connection;
wherein the console device (10) is integrated into the garage door control system;
wherein the console device (10) is coupled communicatively to the external software application;
wherein the external software application is configured to set a face as a means of authorization for actuating the garage door control system by scanning a user's face using the at least one camera (20), and sending facial recognition information to the console device (10);
wherein the console device (10) is coupled communicatively to the obstruction sensor (100);
wherein the transmitter/receiver device (94) accepts a data of a package from the external software application;
wherein the transmitter/receiver device (94) communicates with the memory device (92) to store the data;
wherein the barcode scanner (70) scans a barcode from a package and transmits the scanned barcode information to the processor (90), the barcode scanner scanning the barcode directly without taking a picture of the barcode using a camera and then parsing the picture for determining the barcode;
wherein the processor (90) accepts barcode information from the barcode scanner (72) and executes computer-readable instructions stored in the memory device (92) to compare the scanned barcode information to the data;
wherein the processor (90), if the scanned barcode information corresponds to the data, executes computer-readable instructions to actuate the garage door control system to permit entry;
wherein the transmitter/receiver (94) device sends a notification to the external software application that the garage door control system has opened;
wherein the obstruction sensor (100), if the garage door control system is open, scans for obstructions in a closing path of the garage door control system on a fixed interval;
wherein the obstruction sensor (100), if no obstructions are detected in the closing path, actuates the console device (10) to actuate the garage door control system to close;
wherein the transmitter/receiver (94) device sends a notification to the external software application that the garage door control system was closed;
wherein the transmitter/receiver (94) device sends a notification to the external software application that the package corresponding to the matched barcode was delivered; and
wherein, if the WiFi connection is unavailable, the console device (10) transmits data to the garage door unit (200) by the RF connection to be stored in the storage component, wherein, if the WiFi connection is available, all data stored in the storage component is synced to the external software application.

10. The system of claim 9, wherein the transmitter/receiver (94) device is a radiofrequency transmitter/receiver configured to communicate through the use of WiFi and Bluetooth Low Energy connections.

11. The system of claim 9, wherein the data is a tracking number.

12. The system of claim 9, wherein the fixed interval is 30 to 90 seconds.

13. The system of claim 9, wherein the garage door control system can only be actuated by the console device (10).

14. The system of claim 7, wherein the console device (10) is capable of accepting as an additional means of authorization a numeric code, a password, an authorized fingerprint, or a combination thereof.

15. The system of claim 9, wherein the garage door unit (200) comprises a camera.

16. The system of claim 9, wherein the garage door unit (200) comprises a distance sensor.

17. A method for intelligent secure keyless authorization for package delivery for a garage door control system, the method comprising:
a. pairing an external software application to a console device (10) operatively coupled to the garage door control system by a garage door unit (200) through a communicative connection;
b. pairing the external software application to a plurality of shopping sites;

c. reading, by the external software application, barcode information from an order made on a shopping site from the plurality of paired shopping sites;

d. sending, by the external software application, the data to the console device (10);

e. storing, by the console device (10), the data as a means of authorization;

f. setting, by the external software application, a face as another means of authorization for actuating the garage door control system by scanning a user's face using at least one camera (20) disposed on the console device (10), and sending facial recognition information to the console device (10);

g. scanning a barcode of the package comprising the data with a barcode scanner (70) disposed on the console device (10), the barcode scanner (70) scanning the barcode directly without taking a picture of the barcode using a camera and then parsing the picture for determining the barcode;

h. actuating, by the console device (10), the garage door unit (200) to permit limited entry for the package to be delivered, the limited entry comprising partially opening a garage door of the garage door control system to allow only the package to pass under the garage door;

i. sending, by the console device (10), an alert to the external software application that the garage door control system was opened;

j. checking, by an obstruction sensor (100), for obstructions in the closing path of the garage door control system on a fixed interval;

k. actuating, by the console device (10), the garage door control system to close if the obstruction sensor (100) detects no obstructions while checking;

l. Sending, by the console device (10), an alert to the external software application that the garage door control system was closed;

m. deleting, by the console device (10), the data; and n. sending, by the console device (10), an alert to the external software application that the package corresponding to the barcode was delivered;

wherein, if the barcode of the package does not comprise the data, the garage door control system is not actuated;

wherein the console device (10) comprises a housing with a displaceable cover (80), the displaceable cover (80) moveable between an open position and a closed position, wherein the barcode scanner (70) and the at least one camera (20) are at least partially circumscribed by the housing of the console device (10), and wherein at least a portion of the displaceable cover (80) is disposed between the barcode scanner (70) and the at least one camera (20);

wherein the console device (10) further comprises a solar cell (82) disposed on the displaceable cover (80), and wherein the solar cell (82) generates power to charge the console device (10) when the displaceable cover (80) is in the closed position;

wherein the console device (10) is configured to be connected to the garage door unit (200) by both a WiFi connection and an RF connection, wherein the console device (10) is operatively connected to the garage door unit (200) by the WiFi connection when the WiFi connection is available, wherein, if the WiFi connection is unavailable, the console device (10) is operatively connected to the garage door unit (200) by the RF connection; and wherein the garage door unit (200) comprises a storage component for storing data, wherein, if the WiFi connection is unavailable, the console device (10) transmits data to the garage door unit (200) by the RF connection to be stored in the storage component, wherein, if the WiFi connection is available, all data stored in the storage component is synced to the external software application.

18. The method of claim 17, wherein the data is a tracking number.

19. The method of claim 17, wherein the console device (10) communicates with the external software application through the use of WiFi and Bluetooth Low Energy connections.

20. The method of claim 17, wherein the fixed interval is 30 to 90 seconds.

21. The method of claim 17, wherein the garage door control system can only be actuated by the console device (10).

22. The method of claim 17, wherein the console device (10) is capable of accepting as a further means of authorization a numeric code, a password, an authorized fingerprint, or a combination thereof.

23. A system for intelligent secure keyless authorization for package delivery for a garage door control system through the use of an external software application, the system comprising:

a. a console device (10), the console device comprising:

i. a screen (50), ii. a barcode scanner (70), iii. a processor (90), iv. a RAM device (96), v. a memory device (92), vi. a transmitter/receiver device (94), vii. at least one camera (20), viii. a housing (12) with a displaceable cover (80), and ix. a solar cell (82) disposed on the displaceable cover (80), wherein the screen (50), the barcode scanner (70), and the at least one camera (20) are at least partially circumscribed by the housing of the console device (10), the displaceable cover (80) is moveable between an open position and a closed position, and at least a portion of the displaceable cover (80) is disposed between the barcode scanner (70) and the at least one camera (20), wherein the solar cell (82) generates power to charge the console device (10) when the displaceable cover (80) is in the closed position, wherein the memory device (92) stores data and computer-readable instructions for comparing a barcode to a data and actuating a garage door control system, wherein the processor (90) executes computer-readable instructions stored in the memory device (92), wherein the transmitter/receiver device (94) communicates with a home network, and wherein the transmitter/receiver device (94) communicates with the external software application through the home network; and b. a garage door unit (200) comprising a storage component operatively coupled to the garage door control system and the console device (10);

wherein the console device (10) is integrated into the garage door control system;

wherein the console device (10) is coupled communicatively to the external software application;

wherein the external software application is configured to set a face as a means of authorization for actuating the garage door control system by scanning a user's face using the at least one camera (20), and sending facial recognition information to the console device (10);

wherein the transmitter/receiver device (94) accepts a data of a package from the external software application;

wherein the transmitter/receiver device (94) communicates with the memory device (92) to store the data;

wherein the barcode scanner (70) scans a barcode from a package and transmits the scanned barcode information to the processor (90), the barcode scanner scanning the barcode directly without taking a picture of the barcode using a camera and then parsing the picture for determining the barcode;

wherein the processor (90) accepts barcode information from the barcode scanner (72) and executes computer-readable instructions stored in the memory device (92) to compare the scanned barcode information to the data;

wherein the processor (90), if the scanned barcode information corresponds to the data, executes computer--readable instructions to actuate the garage door control system to permit entry;

wherein the transmitter/receiver (94) device sends a notification to the external software application that the garage door control system has opened;

wherein the transmitter/receiver (94) device sends a notification to the external software application that the garage door control system was closed; and wherein the transmitter/receiver (94) device sends a notification to the external software application that the package corresponding to the matched barcode was delivered.

24. The system of claim 23, wherein the console device (10) communicates with the external software application through the use of WiFi and Bluetooth Low Energy connections.

25. The system of claim 23, wherein the garage door unit (200) comprises a camera.

26. The system of claim 23, wherein the garage door unit (200) comprises a distance sensor.

* * * * *